US009961425B2

(12) United States Patent
Wan et al.

(10) Patent No.: US 9,961,425 B2
(45) Date of Patent: May 1, 2018

(54) LOUDSPEAKER MODULE

(71) Applicant: GOERTEK INC., WeiFang (CN)

(72) Inventors: Ling Wan, WeiFang (CN); Jingwei Wang, WeiFang (CN); Hua Shi, WeiFang (CN)

(73) Assignee: GOERTEK INC., Weifang (CN)

( * ) Notice: Subject to any disclaimer, the term of this patent is extended or adjusted under 35 U.S.C. 154(b) by 107 days.

(21) Appl. No.: 14/898,460

(22) PCT Filed: Sep. 27, 2013

(86) PCT No.: PCT/CN2013/084502
§ 371 (c)(1),
(2) Date: Dec. 14, 2015

(87) PCT Pub. No.: WO2014/198094
PCT Pub. Date: Dec. 18, 2014

(65) Prior Publication Data

US 2016/0150305 A1 May 26, 2016

(30) Foreign Application Priority Data

Jun. 14, 2013 (CN) ..... 2013 1 0236897 A

(51) Int. Cl.
*H04R 1/02* (2006.01)

(52) U.S. Cl.
CPC ..... *H04R 1/026* (2013.01); *H04R 1/025* (2013.01); *H04R 2201/029* (2013.01); *H04R 2499/11* (2013.01)

(58) Field of Classification Search
CPC ..... H04R 1/02; H04R 1/026; H04R 1/025; H04R 2201/029; H04R 2499/11;
(Continued)

(56) References Cited

U.S. PATENT DOCUMENTS 5,825,874 A * 10/1998 Humphreys ..... B60R 11/0241 379/446
6,138,041 A * 10/2000 Yahia ..... B60R 11/0241 379/445

(Continued)

FOREIGN PATENT DOCUMENTS

CN 201839397 U 5/2011
CN 202231834 U 5/2012

(Continued)

OTHER PUBLICATIONS

International Search Report for PCT/CN2013/084502 filed on Sep. 27, 2013.

(Continued)

*Primary Examiner* — Jason R Kurr

(57) ABSTRACT

The present invention relates to the technical field of electro-acoustic products. Provided is a loudspeaker module, comprising a first cover (10) and a second cover (20) combined together; the first cover (10) and the second cover (20) enclose an inner cavity of the module; the inner cavity of the module houses a loudspeaker unit (30) therein; the loudspeaker module further comprises a fastener assembly used to fasten to a fixed structure of an electronic device and thus fix the loudspeaker module to the electronic device. The loudspeaker module solves the technical problem in the prior art of insecure engagement between a loudspeaker module and an electronic device. The loudspeaker module is securely engaged with the electronic device and is easy to install, thus effectively extending the service life of the electronic device installed with the loudspeaker module.

7 Claims, 2 Drawing Sheets

(58) Field of Classification Search
CPC ..... H04R 2205/021; G06F 1/1632; H01R 13/112; H01R 13/15; H01R 13/62; H01R 13/627; H01R 13/6273; H05K 7/14; H05K 7/1405; B60R 11/0217; B60R 11/0241; B60R 11/0252
See application file for complete search history.

(56) References Cited

U.S. PATENT DOCUMENTS

| | | | | |
|---|---|---|---|---|
| 6,438,229 | B1 * | 8/2002 | Overy | H02J 7/0044 379/446 |
| 6,848,662 | B2 * | 2/2005 | Paramonoff | E05C 3/14 248/222.11 |
| 7,920,905 | B2 * | 4/2011 | Bury | B60R 11/0241 379/445 |
| 8,477,953 | B2 * | 7/2013 | Hobson | H01R 13/748 381/59 |
| 9,778,692 | B2 * | 10/2017 | Lan | G06F 1/1632 |
| 2010/0267285 | A1 | 10/2010 | Wang | |

FOREIGN PATENT DOCUMENTS

| | | | |
|---|---|---|---|
| CN | 102811394 | A | 12/2012 |
| CN | 202949532 | U | 5/2013 |
| CN | 103281639 | A | 9/2013 |
| CN | 203301724 | U | 11/2013 |
| KR | 10-2006-0068077 | A | 6/2006 |

OTHER PUBLICATIONS

Chinese Office Action for Application No. 201310236897.3, dated Aug. 4, 2015.
Office Action from Chinese Patent Office for Application No. 20130236897.3, dated Mar. 29, 2016.
Office Action from Korean Patent Office for Application No. 10-2016-7000967, dated Feb. 20, 2017.

* cited by examiner

LOUDSPEAKER MODULE

The present invention is a U.S. National Stage of PCT/CN2013/084502, filed Sep. 27, 2013, which claims the priority of Chinese patent application No. 201310236897.3 filed on Jun. 14, 2013, which are incorporated herein by reference.

FIELD OF THE INVENTION

The present invention relates to the field of electro-acoustic products, and more specifically, to a loudspeaker module.

BACKGROUND

Along with the rapid development of the electronic industries, portable electronic devices are getting very popular since they are convenient to carry, full of features and capable of meeting the needs of surfing on Internet, communication, entertainment and so on. With the rapid development and popularization of the portable electronic devices, loudspeaker modules serving as an important acoustic part in the electronic devices are also continually improved.

A prior loudspeaker module, comprising a case and a loudspeaker unit accommodated in the case, is fixed in a portable electronic device mainly by a sticking process. The fixation manner of the loudspeaker module stuck to the portable electronic device has a disadvantage in that the loudspeaker module may not be firmly combined with the portable electronic device, and is easy to fall off it when it receives an external shock, which will severely affect the service life of the portable electronic device.

In view of the above drawback, those skilled in the art additionally dispose a fixed structure in a portable electronic device to prevent the loudspeaker module from falling off. Therefore, a loudspeaker module capable of fastening to the fixed structure of the electronic device is needed to ensure a firm combination of the loudspeaker module with the portable electronic device.

SUMMARY

The technical problem to be solved by the present invention is to provide a loudspeaker module, which can be firmly combined with a fixed structure of a portable electronic device, and thus with the portable electronic device, so that the loudspeaker will not fall off the portable electronic device.

Furthermore, the technical problem to be solved by the present invention is to provide a loudspeaker module, which can be firmly combined with a fixed structure of a portable electronic device in a simple and convenient operation.

To solve the above technical problem, there is provided a loudspeaker module, comprising a first cover and a second cover, wherein the first cover and the second cover enclose an inner cavity of the module and the inner cavity of the module houses a loudspeaker unit therein, the loudspeaker module further comprises a fastener assembly, which is used to fasten to a fixed structure of an electronic device so that the loudspeaker module is fixed on the electronic device.

The fastener assembly may comprise a plurality of fasteners capable of performing straight reciprocating motion. Each of the fasteners may comprise a fastener body disposed in the inner cavity of the module, a fastening part disposed on the fastener body and having an extending direction vertical to that of the fastener body, wherein the fastening part passes through the top of the first cover, the exposed end thereof is used to fasten to the fixed structure of the electronic device, and a motion clearance is provided on the first cover for the fastening part, and a connection part and a press part disposed on the two ends of the fastener body, respectively, wherein the press part passes through the second cover. The fastener assembly may further comprise a spring connecting to the connection parts.

Preferably, a first through hole may be disposed on the top of the first cover for the fastening part to pass through, the motion clearance is provided between the edge of the first through hole and the fastening part passing therethrough.

Preferably, the extending directions of the connection part and the press part may be both same as that of the fastener body, a second through hole may be disposed on a sidewall of the second cover and at a position where the press part is located, the press part passes through the second through hole.

Preferably, the fastener assembly may comprise two fasteners, the two fasteners are symmetrically disposed, and the connection parts of the two fasteners are connected to the two ends of the spring, respectively.

Preferably, the two fasteners may be disposed on the inner side of the second cover through a fastener support.

Preferably, the fastener assembly and the loudspeaker unit may be horizontally disposed side by side.

The advantageous effects of the present invention are as follows. The loudspeaker module according to the present invention comprises a fastener assembly, which is used to fasten to a fixed structure of an electronic device so that the loudspeaker module is fixed on the electronic device. The fastening manner by which the fastener assembly fastens to the fixed structure of the electronic device produces a stronger combination effect than the sticking manner in the prior art, so that the loudspeaker module will not easily fall off when the electronic device receives an external shock. Thus, the loudspeaker module according to the present invention can be firmly combined with electronic devices, so that the service life of the electronic devices having the loudspeaker module according to the present invention installed therein is extended.

The fastener assembly according to the present invention comprises a plurality of fasteners capable of performing straight reciprocating motion. Each of the fasteners comprises a fastener body disposed in the inner cavity of the module, a fastening part disposed on the fastener body, wherein the fastening part passes through the top of the first cover, the exposed end thereof is used to fasten to the fixed structure of the electronic device, and a motion clearance is provided on the first cover for the fastening part, and a connection part and a press part disposed on the two ends of the fastener body, respectively, wherein the press part passes through the second cover. The fastener assembly further comprises a spring connecting to the connection parts. Such a structure of the fastener assembly allows a very convenient fixation of the loudspeaker module. In details, the press parts of the fasteners are pressed to compress the spring, the fasteners are moved along a straight line so that the fastening parts of the fasteners connect to the fixed structure of the electronic device, then the forces exerted on the press parts of the fasteners are withdrawn, so that the fasteners are restored under the expansion forces of the spring to fasten to the fixed structure of the electronic device. It can be seen from the above description that it is simple to operate the fasteners, and the loudspeaker module can be conveniently installed on the electronic device.

The two fasteners are symmetrically disposed, and the connection parts of the two fasteners are connected to the two ends of the spring, respectively. Therefore, the combination of the loudspeaker module and the electronic device can be further enhanced, and the installation of the loudspeaker module can be more convenient.

The fastener assembly and the loudspeaker unit are horizontally disposed side by side. Therefore, the combination of the loudspeaker module and the electronic device can be enhanced without increasing the thickness of the module and changing the acoustic performance of the same, and thus the overall performance of the loudspeaker module can be improved.

In summary, the loudspeaker module of the present invention solves a technical problem in the prior art that the loudspeaker module may not be firmly combined with an electronic device, and is easy to fall off. The loudspeaker module according to present invention can firmly fasten to an electronic device, and the installation thereof is convenient, therefore, the service life of the electronic devices having the loudspeaker module according to the present invention installed therein is effectively extended.

DETAILED DESCRIPTION

The loudspeaker module according to the present invention will be described in details in conjunction with the drawings and embodiments.

Figure 1:
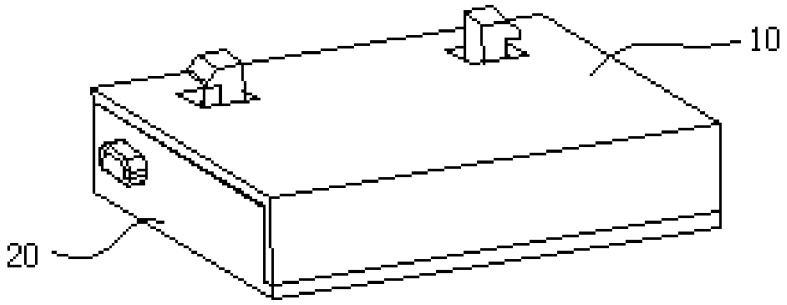
FIG. 1 is a schematic view showing a loudspeaker module according to the present invention.
Figure 2:
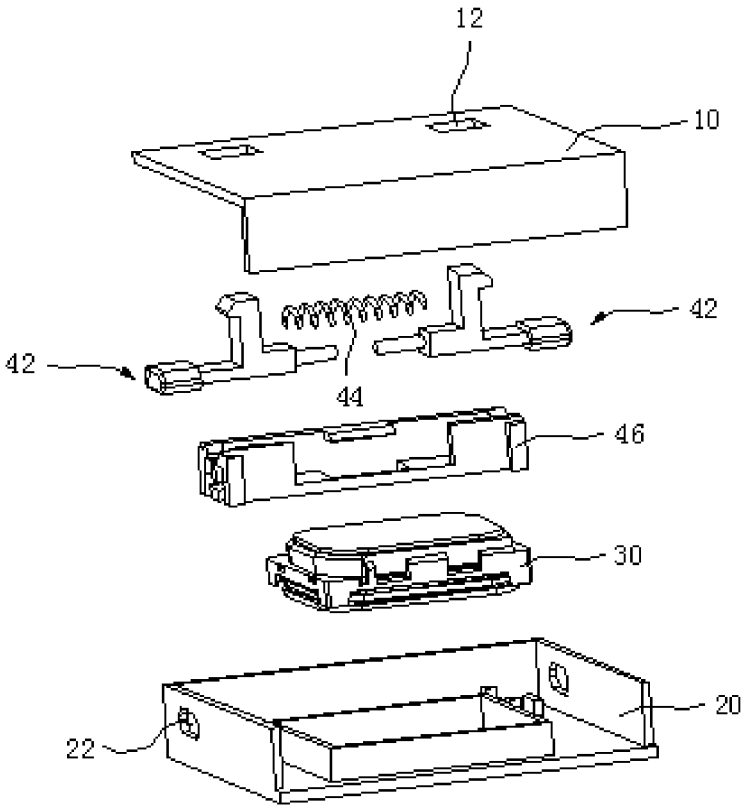
FIG. 2 is an exploded view of FIG. 1.

As shown in FIG. 1 and FIG. 2, the loudspeaker module according to the present invention comprises a case, the case is formed with a first cover 10 and a second cover 20, wherein the first cover 10 and the second cover 20 enclose an inner cavity of the module and the inner cavity of the module houses a loudspeaker unit 30 therein, the loudspeaker module further comprises a fastener assembly, which is used to fasten to a fixed structure of an electronic device so that the loudspeaker module is fixed on the electronic device. The fastener assembly will be described in details thereinafter. The fastener assembly and the loudspeaker unit 30 may be horizontally disposed side by side on the inner side of the second cover 20, however, the present invention is not limited thereto. The combination of the loudspeaker module and the electronic device can be enhanced by the fastener assembly without increasing the thickness of the module and changing the acoustic performance of the same, and the fastening manner produces a stronger combination effect than the sticking manner in the prior art, so that the loudspeaker module will not easily fall off when the electronic device receives an external shock.

Figure 3:
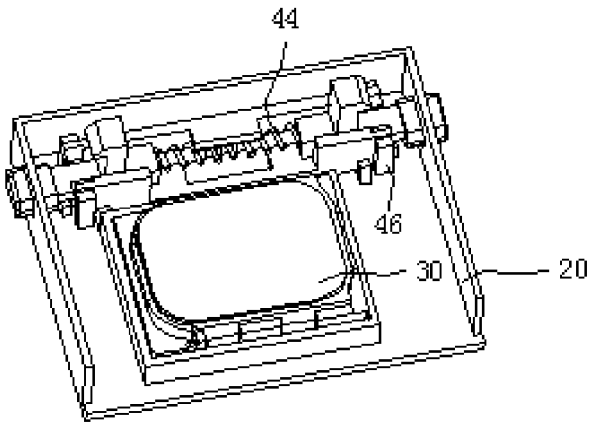
FIG. 3 is schematic view showing the inner structure of the loudspeaker module according to the present invention.
Figure 5:
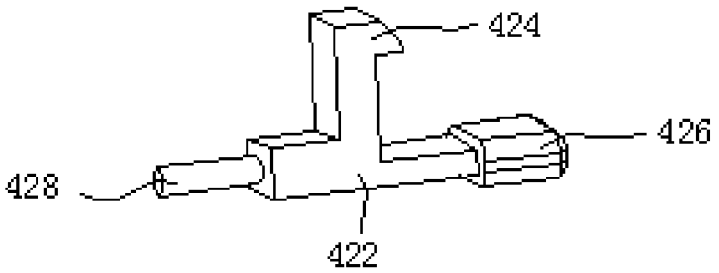
FIG. 5 is a schematic view showing a structure of one of the fasteners of the loudspeaker module according to the present invention.

As shown in FIG. 2 and FIG. 3, the fastener assembly comprises two fasteners 42 capable of moving against each other, and the two fasteners 42 are symmetrically disposed. However, the fastener assembly according to the present invention may comprise more than two fasteners. The structure of the fastener 42 is shown in FIG. 5. The fastener comprises a fastener body 422 disposed in the inner cavity of the module, a fastening part 424 disposed on the fastener body 422 and having an extending direction vertical to that of the fastener body 422, wherein the fastening part 424 passes through the top of the first cover 10, the exposed end thereof is used to fasten to the fixed structure of the electronic device and is formed with a right-angle bend, and a connection part 428 and a press part 426 disposed on the two ends of the fastener body 422, respectively, and having an extending direction consistent with that of the fastener body 422, wherein the press part 426 passes through the second cover 20. The fastener assembly further comprises a spring 44 with the two ends thereof connecting to the connection parts 428 of the two fasteners 42, respectively. The two fasteners 42 are disposed on the inner side of the second cover 20 through a fastener support 46.

As shown in FIG. 1 and FIG. 2, a first through hole 12 is disposed for each of the fastening parts 424 of the two fasteners 42 on the top of the first cover 10, and the end of each of the fastening parts 424 pass through the corresponding first through hole 12, and a motion clearance is provided between the edge of the first through hole 12 and the fastening part 424 passing therethrough for the straight line motion of the fastener 42. Second through holes 22 are disposed on the opposite sidewalls of the second cover 20 and at positions where the press parts 426 are located, the press parts 426 pass through the corresponding second through holes 22.

Figure 4:
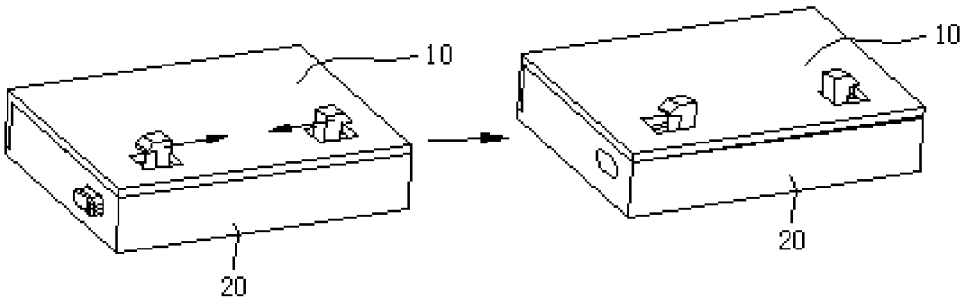
FIG. 4 is a schematic view showing a state change of the fasteners of the loudspeaker module according to the present invention.

As shown in FIG. 4, when the loudspeaker module is installed, the press parts 426 of the fasteners exposed out of the two sides of the module are pressed inwards, and the two fasteners 42 will compress the spring 44, so that the fastening parts 424 of the fasteners 42 connect to the fixed structure of the electronic device, then the forces exerted on the press parts 426 of the fasteners are withdrawn, so that the fasteners 42 are restored under the expansion forces of the spring 44 to fasten to the fixed structure of the electronic device. It can be seen from the above description that it is simple to install the loudspeaker module according to the present invention, and the loudspeaker module can be conveniently installed on the electronic device, and the combination of the loudspeaker module and the electronic device can be enhanced.

The present disclosure refers to the following elements of the figures: 10: the first cover, 12: the first through hole, 20: the second cover, 22: the second through hole, 30: the loudspeaker unit, 42: the fastener, 422: the fastener body, 424: the fastening part, 426: the press part, 428: the connection part, 44: the spring, 46: the fastener support.

The present invention is not limited to the specific embodiments described above. Various modifications made by those skilled in the art that start with the inventive conception of the present invention and involve no other inventive work are all fall within the protection scope of the present invention.

What is claimed is:

1. A loudspeaker module, comprising:

a first cover;

a second cover, wherein the first cover and the second cover enclose an inner cavity of the module and the inner cavity of the module houses a loudspeaker unit therein; and a fastener assembly, which is used to fasten to a fixed structure of an electronic device so that the loudspeaker module is fixed on the electronic device, wherein the fastener assembly comprises a plurality of fasteners capable of performing straight reciprocating motion, and wherein each of the fasteners comprises:

a fastener body disposed in the inner cavity of the module;

a fastening part disposed on the fastener body and extending orthogonal to the fastener body, wherein the fastening part passes through the top of the first cover along the entire path of straight reciprocating motion, the exposed end thereof is used to fasten to the fixed structure of the electronic device, and a motion clearance for the fastening part is provided on the first cover; and wherein one end of each fastener is a press part, and an opposing end of each fastener is a connection part, wherein the press part passes through the second cover, and wherein the fastener assembly further comprises a spring connecting the connection parts.

2. The loudspeaker module according to claim 1, wherein a first through hole is disposed on the top of the first cover for the fastening part to pass through, and wherein the motion clearance is provided between the edge of the first through hole and the fastening part passing therethrough.

3. The loudspeaker module according to claim 2, wherein the extending directions of the connection part and the press part are both same as that of the fastener body, a second through hole is disposed on a sidewall of the second cover and at a position where the press part is located, and the press part passes through the second through hole.

4. The loudspeaker module according to claim 1, wherein the fastener assembly comprises two fasteners, the two fasteners are symmetrically disposed, and the connection parts of the two fasteners are connected to two ends of the spring, respectively.

5. The loudspeaker module according to claim 4, wherein the two fasteners are disposed on the inner side of the second cover through a fastener support.

6. The loudspeaker module according to claim 5, wherein the fastener assembly and the loudspeaker unit are horizontally disposed side by side.

7. The loudspeaker module according to claim 4, wherein when the loudspeaker module is fastened to the electronic device, the press parts of the fasteners exposed out of two opposite sides of the speaker module are pressed inwards, and the two fasteners compress the spring, so that the fastening parts of the fasteners are connected to the fixed structure of the electronic device, then forces exerted on the press parts of the fasteners are withdrawn, so that the fasteners are restored under expansion forces of the spring so as to be fastened to the fixed structure of the electronic device.

* * * * *